US007784245B2

(12) United States Patent
Dumargue

(10) Patent No.: US 7,784,245 B2
(45) Date of Patent: Aug. 31, 2010

(54) CONTAINER CAPPING DEVICE MINIMIZING THE RISK OF POLLUTION

(75) Inventor: Guy Dumargue, Cherre (FR)

(73) Assignee: Serac Group, Le Ferte Bernard (FR)

( * ) Notice: Subject to any disclaimer, the term of this patent is extended or adjusted under 35 U.S.C. 154(b) by 0 days.

(21) Appl. No.: 12/328,563

(22) Filed: Dec. 4, 2008

(65) Prior Publication Data

US 2009/0145083 A1 Jun. 11, 2009

(30) Foreign Application Priority Data

Dec. 5, 2007 (FR) ..... 07 08490

(51) Int. Cl.
*B65B 7/00* (2006.01)

(52) U.S. Cl. ..... 53/285; 53/317; 53/331.5; 53/490

(58) Field of Classification Search ..... 53/285, 53/317, 319, 331.5, 490
See application file for complete search history.

(56) References Cited

U.S. PATENT DOCUMENTS 2,106,365 A * 1/1938 Tiano ..... 53/317
2,613,489 A 10/1952 Terry
2,705,101 A * 3/1955 Evcrett ..... 53/317
2,819,577 A * 1/1958 Dimond ..... 53/317
3,242,632 A * 3/1966 Dimond ..... 53/67
4,099,361 A * 7/1978 Dix et al. ..... 53/488
4,186,542 A * 2/1980 Oyagi ..... 53/88
4,357,787 A * 11/1982 Long ..... 53/317
5,417,031 A * 5/1995 Bankuty et al. ..... 53/331.5
7,334,380 B2 * 2/2008 Brunee ..... 53/317

FOREIGN PATENT DOCUMENTS

DE 37 15 935 11/1988
EP 0 863 106 9/1998
EP 1 834 923 9/2007

* cited by examiner

*Primary Examiner*—Thanh K Truong
(74) *Attorney, Agent, or Firm*—Muncy, Geissler, Olds & Lowe, PLLC

(57) ABSTRACT

The container capping device includes a capping head carried by a hollow support member in the shape of a bracket, vertically movable and including a vertical part going through a cover, with the rotation driving mechanism of the capping head and the control mechanism of the jaws of the capping head being enclosed in the part of the support member which extends above the cover.

7 Claims, 1 Drawing Sheet

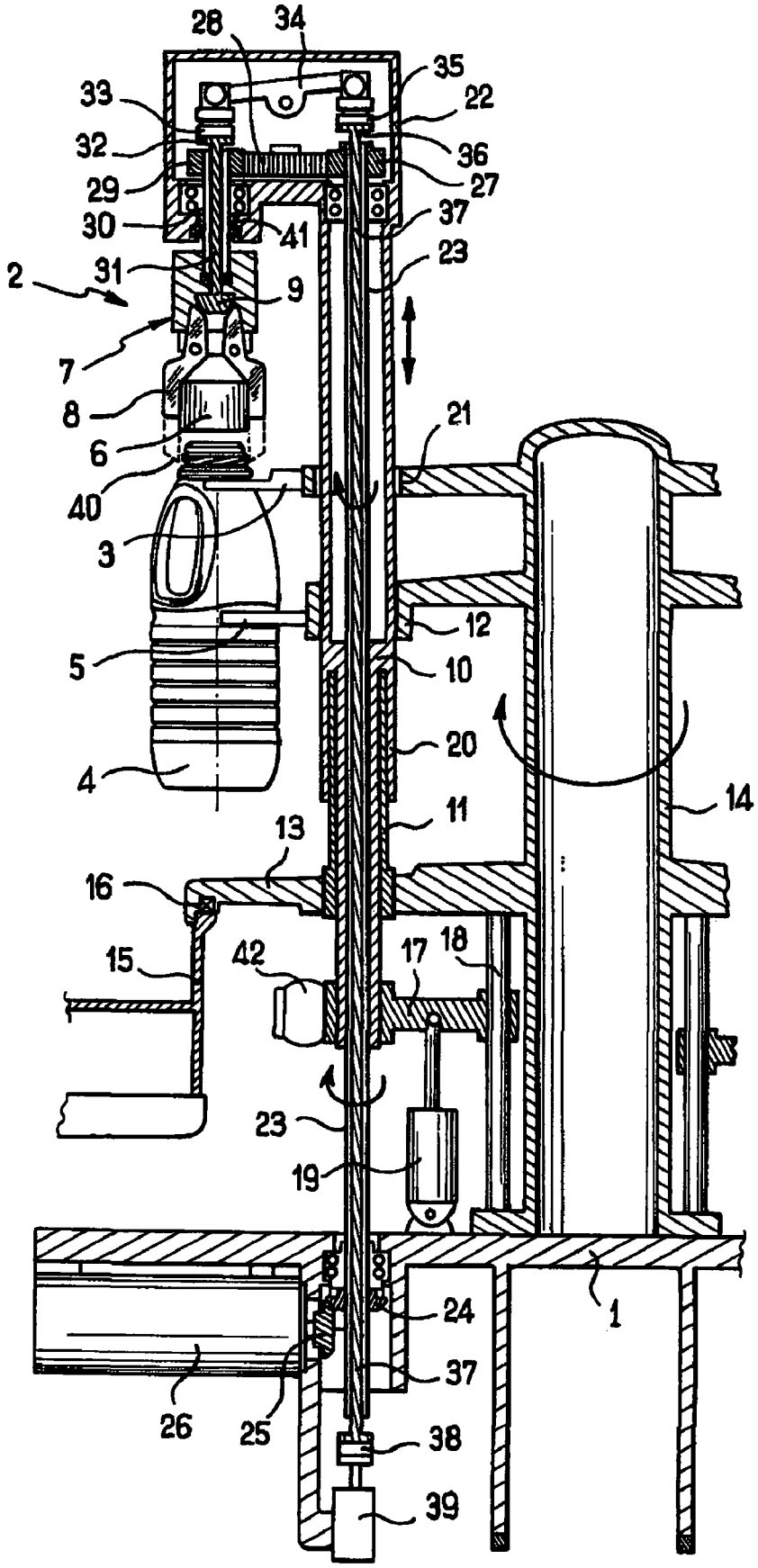
28
34
35
33
22
32
36
29
27
30
41
37
2
31
23
9
7
8
21
6
40
3
12
5
10
20
4
14
11
13
16
15
42
17
18
23
19
24
1
37
26
25
38
39

CONTAINER CAPPING DEVICE MINIMIZING THE RISK OF POLLUTION

BACKGROUND OF THE INVENTION

1. Field of the Invention

The present invention relates to a container capping device.

2. Brief Discussion of the Related Art

It is known that for capping containers at a high rate, whether the containers are capped by thermo-sealed capsules or the containers are capped by screwed caps, it is desirable to provide facilities including a series of capping devices operated in sequence.

More particularly, it is known from document EP-A-1 834 923 to provide a carrousel including a rotating platform on which the capping devices are mounted, so that a capping process is carried out between an inlet device feeding the containers to be capped, and an outlet device carrying away the capped containers, with the capping member being taken in the dead angle between the outlet device and the inlet device, when referring to the rotation direction of the platform.

In the device of the above-mentioned document, each capping device includes a capping head carried out by a support member having the shape of a bracket and including a vertical part going through a cover and connected to a handling member positioned under the cover. The capping head is removably mounted along a vertical movement between a high position and a low position and at right angles with a container support. A complete capping cycle includes the raising of the capping head just prior to the coming out of a container, so as not to interfere with the coming out of the container, the lowering of the capping head in order to take off a cap or possibly a capsule, the raising of the capping head not to interfere with the coming out of the containers and a lowering of the capping head during the step of the fixing of the cap or the capsule on the container.

In order to carry out all these motions, the means for implementing the capping heads, i.e. the means for driving the capping head and the means for controlling the motions of the capping heads, are usually positioned above the capping heads.

Because of the position of these mechanisms, the motions on the various parts entail a pollution which may enter the containers, which is not compatible with the aim of a maximum sterility in the case of an aseptic packaging of the product. In addition, when the facilities are provided with a sterile air flow device giving a laminar flow to keep the volume surrounding the containers sterile, in the present position thereof, the means for implementing the capping heads are obstacles to the flow of sterile air and thus are liable to break the sterile barrier which is wanted around the containers.

SUMMARY OF THE INVENTION

One aim of the invention is to provide a device for capping containers minimizing the risk of pollution.

For this purpose, the invention provides a device for capping containers including a capping head carried by a support member in the shape of a bracket including a vertical part going through a cover and connected to a handling member positioned under the cover, the capping head being connected to a horizontal branch of the bracket to be movable along a vertical movement between a high position and a low position above and at right angle with a container support, the capping head being connected to means for the implementation thereof, wherein that the support member is hollow and the means for implementing the capping heads are enclosed in the part of the support member which extends above the cover.

Thus, the pollution which might be generated by the means for implementing the capping heads remains enclosed within the part of the support member above the cover and under the cover so that there is no risk of penetration in the containers.

According to an advantageous version of the invention, the member supporting the capping head includes a support tube mounted to slide with respect to a guiding member on an interface zone, wherein the support tube and the guiding member are in a variable overlapping position, the interface zone extending at the level lower than the lower end of the capping head in the low position of the capping head. Then, the container being capped cannot be reached by a pollution coming from the frictions between the support tube and the guiding member.

According to another advantageous aspect of the invention, the capping head is provided with means for gripping a cap, driven in rotation by a rotation driving mechanism extending inside a support member and including a driving rod connected to a driving motor positioned under the cover. Thus, the bigger parts of the mechanisms are positioned in the biggest available volume and are accessible without breaking the sterility of the critical parts.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawing, which is given by way of illustration only, and thus is not limitative of the present invention.

The FIGURE is a schematic cross-sectional view of a capping device according to the invention with a vertical plane going through a plane of symmetry of the support member.

DETAILED DESCRIPTION OF THE PREFERRED EMBODIMENTS

While referring to the FIGURE, the invention will now be described while referring to a capping device including a capping head with jaws, but the invention also applies, with a few adaptations, to a capping device including a capping head with an elastic cone for gripping the caps or a heating capping head so that the lids can be heat-sealed.

While referring to the FIGURE, the capping device is described while referring to a rotating capping carrousel including a series of capping stations, only one of which is shown in the FIGURE. In a way known per se, the facilities include a rotating platform 1 carrying a series of capping devices 2, each being associated with a container 3 support member, here a clamp, to hold the containers 4 by the neck. In another way also known per se, each capping station includes an anti-rotation member 5 positioned with respect to the containers to prevent these from rotating when the cap is screwed 6 by the capping head 7.

In the embodiment illustrated, the capping head 7 is, also in a way known per se, carried by a support member having the shape of a bracket including a vertical part 10 going through a cover 13 and connected to a handling member positioned under the cover, with the capping head being connected to a horizontal branch of the bracket to be movable along a vertical motion between a high position and a low position above and at right angle with the container 3 support. The capping head includes jaws 8 which are returned to an open position by elastic members not shown and the closing of which is provided by a control member 9 mounted to be movable between parts of the jaws.

According to the invention, the support member is hollow and includes a support tube 10 which extends vertically, and guided by a guiding tube 11 on the one hand and by a guiding ring 12 carried by the support arm of the anti-rotation device 5, on the other hand. The guiding tube 11 is sealingly fixed to the cover 13 integral with a central mast 14 fixed to the rotating platform 1. The cover 13 extends under the capping head 7 and is associated, along the outer edge thereof, with a partition element 15 carried by the frame of the machine. A joint 16 provides the sealing between the cover 13 and the partition element 15. The support tube 10 goes through the cover 13 and the lower end of the support tube 10 is fixed to a handling member including a handling arm 17 mounted to slide on a vertical small column 18 carried by the platform. The position of the handling arm 17 is determined by a roller 42 cooperating, in a way known per se, with cams not shown and positioned in particular points of the circular path of the platform 1, so as to determine precisely the position of the support 10.

The pressure force of the capping head on the container is further determined by a cylinder 19 which acts on the arm 17.

In the preferred embodiment illustrated, the guiding tube 11 encloses the support tube 10 and the latter includes a skirt 20 which is sealingly fixed to the support tube 10 and covers the upper end of the guiding tube 11. Thus, during the vertical reciprocating motions of the support tube 10, the upper end of the guiding tube 11 remains constantly covered by the skirt 20, so that the particles which might be generated by the friction of the support tube 10 inside the guiding tube 11 cannot escape upwards, but are on the contrary pulled downwards under the cover 13 so that they cannot reach the container.

As regards the pollution which might be generated by the friction of the support tube 10 with the guiding ring 12, it should be noted that this solution would be generated under the opening of the container 4, i.e. under the level reached by the lower end of the capping pin 7 when the latter is in the low position illustrated by dashes 40 in the FIGURE. The risk of a pollution by the loading particles which would go up towards the opening of the container 4 does not exist and more particularly during the utilization of a flow of sterile air flowing from the ceiling of the facilities. It should be noted that the passage 21 for the support tube 10 in the arm carrying the support clamp 3 is very close to the opening of the container 4. To prevent any pollution from being generated by the motions of the support tube 10 through the passage 21, the latter has large dimensions. The upper end thereof, the support tube 10 is connected to a housing 22 which extends horizontally and forms a support member having the shape of a bracket with the support tube 10. The housing 22 forms a horizontal branch of such support member. This horizontal member carries the capping head 7 which extends vertically under the horizontal branch 22.

The driving into rotation of the capping head 7 is obtained using a hollow shaft 23 which extends inside the support tube 10, coaxially thereto. At the lower end thereof which extends under the cover 13 beyond the lower end of the support tube 10, the hollow shaft 23 includes a ribbed part which goes through a conical pinion 24 cooperating with a conical pinion 25 carried by the motor driving shaft 26 fixed under the platform 1. Considering the position of this driving mechanism under the hood 13, the risk of pollution by the driving mechanism is totally eliminated, contrarily to the prior devices wherein the rotation driving mechanism is positioned above the capping head.

At the upper end thereof which extends into the housing 22, the hollow shaft 23 carries a pinion 27 cooperating with an intermediate pinion 28 engaging with a pinion 29 which a hollow shaft 30 is associated with, and the lower end of which carries the capping head 7. Upon the rotation of the hollow shaft 23 by the driving motor 26, the rotation motion is transmitted to the hollow shaft 30 which thus rotates the capping head 7. It should be noted that the only movable part at right angle and above the capping head 7 is the hollow shaft 30 the position of which minimizes the risk of pollution. In order to further minimize the risk of pollution the housing 22 is provided with an O-ring 41 surrounding the hollow shaft 30, at the housing 22 outlet.

The control member 9 of the jaws of the capping head 7 is connected to the control rod 31 which extends inside the hollow driving shaft while rotating 30. The control rod 31 is driven in rotation simultaneously with the hollow shaft 30. At the upper part thereof, the control rod 31 includes a plate 32 whereon a ball stop 33 is provided, so that one end of a rocker arm 34 mounted inside the housing 22 can rest. The opposite end of the rocker arm 34 similarly rests on a ball stop 35 carried by a plate 36 fixed at the upper end of a control rod 37, the lower end of which presses on a control cylinder 39 through a ball stop 38. The control rods 31 and 37 can thus be handled during the rotation of the capping head 7.

Of course, the invention is not limited to the embodiment illustrated and modified embodiments can be made without leaving the scope of the invention such as defined by the claims.

More particularly, although the invention has been described with a device including a capping head with jaws, the invention may also be applied to the capping device including a capping head with an elastic gripping cone. In this case, the control rods 31 and 37 and the rocker arm 34 are eliminated as well as the control cylinder 39.

Similarly, the capping head 7 can be replaced by a thermo-sealing head. In this case, the support tube 10 and the housing 22 contain the electric supply of the thermo-sealing head and if need be, a pneumatic pipe providing the taking of the lids to be sealed.

Although the invention has been described while referring to containers hanging by the necks during the capping operation, the invention can also be applied to facilities wherein the containers 4 are supported by the bottom thereof.

Although the invention was illustrated with all the control and driving mechanism positioned at a lower level of the containers, some parts of the equipment can be positioned beside the containers, provided that the movable parts able to generate a pollution are placed under the opening of the containers, i.e. under the lower position of the capping head.

Although the invention has been illustrated with a control rod 37 extending inside the hollow driving shaft 23, the control rod 37 can be mounted parallel to the control shaft 23 inside the support tube 10. In this case, the control rod is not driven into rotation upon the rotation of the driving shaft 23 and the ball stops 35 and 38 can thus be eliminated.

The set of pinions 27, 28, 29 can be replaced by a transmission mechanism with an indented belt or similar.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for capping containers including a capping head carried by a support member having the shape of a bracket including a vertical part going through a cover and connected to a handling member positioned under the cover, the capping head being connected to a horizontal branch of the bracket to be movable along a vertical motion between a high position and a low position above and at right angle with a container support extending above the cover, the capping head being connected to means for the implementation thereof, the support member being hollow and the means for implementing the capping heads being enclosed in the part of the support member which extends above the cover, wherein the vertical part of the support member includes a support tube mounted to slide with respect to a guiding member on an interface zone, wherein the support tube and the guiding member are in a variable overlapping position and in that the interface zone extends at a level lower than the lower end of the capping head in the low position of the capping head, and wherein the capping head is provided with means for gripping a cap driven in rotation by a rotation driving mechanism extending inside the support member and connected to a driving motor positioned under the cover.

2. The device according to claim 1, wherein the guiding member encloses a part of the support tube and in that the support tube includes a skirt having an upper end sealingly fixed to the support tube and covering an upper end of the guiding member.

3. The device according to claim 1, wherein guiding member is sealingly fixed on the cover.

4. The device according to claim 3, wherein the guiding member encloses a part of the support tube, and in that the support tube includes a skirt having an upper end sealingly fixed to the support tube and covering an upper end on the guiding member.

5. The device according to claim 1, wherein the mechanism for driving the capping head in rotation includes two vertical shafts connected by a transmission mechanism positioned in the horizontal part of the support member.

6. The device according to claim 1, wherein the cap gripping means include jaws controlled by a control mechanism including control rods connected by a rocker arm positioned in the horizontal branch of the support member.

7. The device according to claim 6, wherein the control rods extend inside tubular driving shafts of the rotation driving mechanism.

* * * * *